US006209461B1

(12) United States Patent
Riffet et al.

(10) Patent No.: US 6,209,461 B1
(45) Date of Patent: Apr. 3, 2001

(54) NON-LETHAL PROJECTILE

(75) Inventors: Régis Riffet, Roquettes; Walter Simonella, Toulouse; Guy Valembois, Blagnac, all of (FR)

(73) Assignee: Etienne Lacroix Tous Artifices S.A. (FR)

( * ) Notice: Subject to any disclaimer, the term of this patent is extended or adjusted under 35 U.S.C. 154(b) by 0 days.

(21) Appl. No.: 09/202,842

(22) PCT Filed: Jun. 20, 1997

(86) PCT No.: PCT/FR97/01109

§ 371 Date: May 25, 1999

§ 102(e) Date: May 25, 1999

(87) PCT Pub. No.: WO97/49969

PCT Pub. Date: Dec. 31, 1997

(30) Foreign Application Priority Data

Jun. 21, 1996 (FR) ..... 96 07780

(51) Int. Cl.[7] ..... F42B 12/40

(52) U.S. Cl. ..... 102/513; 102/334; 102/364; 102/367; 102/395; 102/498; 102/502; 222/5

(58) Field of Search ..... 102/334, 364, 102/367–370, 395, 440, 498, 502, 513, 529; 222/5

(56) References Cited

U.S. PATENT DOCUMENTS

| | | | | |
|---|---|---|---|---|
| 1,671,364 | | 5/1928 | Gangnes | 102/370 |
| 3,091,365 | * | 5/1963 | Horner et al. | 222/5 |
| 4,195,572 | | 4/1980 | Knapp | 102/90 |
| 4,667,601 | | 5/1987 | Diamond et al. | 102/368 |
| 5,078,117 | * | 1/1992 | Cover | 102/440 |
| 5,415,845 | * | 5/1995 | Brede et al. | 102/370 |

FOREIGN PATENT DOCUMENTS

| | | | |
|---|---|---|---|
| 506770 | 1/1969 | (CH) | F42B/13/32 |
| 0733875 | 9/1996 | (EP) | F42B/12/50 |
| 2598215 | 5/1986 | (FR) | F42B/13/20 |
| 1354307 | 6/1971 | (GB) | F41B/11/00 |
| WO 91/01479 | 2/1991 | (WO) | F42B/40/50 |

OTHER PUBLICATIONS

Navy Technical Disclosure Bulletine, vol. V, No. 3, Mar. 1980, Arlington Virginia, pp. 43–46.

* cited by examiner

*Primary Examiner*—Harold J. Tudor
(74) *Attorney, Agent, or Firm*—Blakely Sokoloff Taylor & Zafman

(57) ABSTRACT

The present invention relates to a non-lethal projectile. The projectile (1) comprises a longitudinal body (5) having internally a longitudinal striker (55) suitable for perforating a container (47) of fluid under pressure in controlled manner, in particular by impact of the projectile (1) on a target. The striker (55) has an internal passage (59) opening to the outside of the body (5) via channels (60) made through a rigid wall (35) secured to the body (5) such that the outlet offered to the fluid under pressure remains disengaged even if the impact is accompanied by the deformation of the container (47). The fluid contained in the container (47) can thus escape and spread over the target even in such a case.

18 Claims, 5 Drawing Sheets

NON-LETHAL PROJECTILE

FIELD OF THE INVENTION

The present invention relates to a non-lethal projectile adapted to be projected, in particular fired from a tube in a predetermined longitudinal direction, and to disperse a pressurized fluid in a controlled manner, in particular by impacting on a target in said direction.

BACKGROUND OF THE INVENTION

In the present context "tube" means either a weapon barrel housing the projectile directly until it is fired or a tubular case surrounding the projectile at least locally within the weapon barrel and remaining in the barrel when The projectile is fired.

European Patent Application No. 96400608.4 filed Mar. 22, 1996 by the Applicant describes an embodiment of a projectile of the above kind for dispersing a pressurized incapacitating or marking fluid in which the fluid dispersing means comprise a plurality of transverse orifices in a part of the body housing the container in the immediate proximity of the transverse wall carrying the striker. This prior art projectile is designed to be fired in a particular longitudinal direction from a weapon barrel and to release the pressurized fluid from the container as a result of inertial striking on impact on a target in that direction.

The above solution is not totally satisfactory in that the impact energy can be sufficient to cause not only striking (i.e. perforation) of the container by the striker, but also crushing of the container against the transverse wall carrying the striker, with the effect of crimping the container inside the body and/or to the striker in the immediate proximity of the aforementioned transverse wall, i.e. in the area in which the orifices are located.

This causes at least partial blocking of the orifices, making the projectile less effective. It is important for the fluid not only to exit the projectile but also to exit it in an extremely short time period, i.e. before the projectile falls to the ground after striking its target.

Also known, from FIG. 7 of British patent No. 1 354 307 is a projectile comprising, inside a body, a container which, on impact of the projectile on a target in a determined longitudinal direction, breaks against a striker so that its content escapes via lateral vents formed through the wall of the projectile body around the container, i.e. on the same side as the latter of a wall carrying the striker, as in the case of the projectile described in the above-mentioned European patent application.

Nevertheless, the container described in British patent No. 1 354 307 is not suitable for being perforated, but breaks into numerous pieces when it hits the striker, thereby making it necessary to provide firstly a cushion behind the container, in particular to protect it while the projectile is being fired, and secondly grids inside the vents to prevent pieces of the container from escaping together with the content thereof, since that would run the risk of injuring people in the vicinity.

In contrast, the present invention relates to projectiles in which the container is suitable for being perforated and opens on being perforated by means of the striker, as taught in the above-mentioned European patent application.

Also known, from U.S. Pat. No. 1,671,364, is a projectile having a tube that dips permanently into a volume containing a fluid to be expelled and communicating with channels formed in a rigid wall of the projectile.

The volume described in that document is no more a container suitable for being perforated than is the container described in the above-mentioned British patent, and the volume does not contain a fluid under pressure which is released by such a container being perforated. Release is performed by the effect of the volume telescoping and disengaging stoppers that initially closed a T-shaped end of the tube remote from the rigid wall in which the outlet channels are provided.

Consequently, neither British patent No. 1 354 307 nor U.S. Pat. No. 1,671,364 relates to a projectile implementing a container suitable for being perforated by the effect of a striker, i.e. of the type described in the above-mentioned European patent application. In particular, neither of those documents teaches means for remedying the above-mentioned drawback of the projectile described in said European patent application.

SUMMARY OF THE INVENTION

The present invention aims to remedy that drawback of the projectiles described in European Patent Application No. 9640068.4, and to this end it proposes a projectile of the type indicated in the preamble characterized in that the fluid dispersing means include a blind longitudinal passage through the striker open at the end towards the container and closed inside said wall, and a plurality of transverse passages in said wall radiating from said passage and discharging externally of the body.

The skilled person will readily see that under these conditions any crushing of the container against the transverse wall carrying the striker has no effect on the exit of the pressurized fluid and that it is therefore certain that the projectile in accordance with the invention will release the fluid that it contains in a very short time period after impact on its target if striking is caused by inertia on impact.

An embodiment of the fluid dispersing means of the above kind naturally accommodates any mode of striking the container, i.e. the use of any phenomenon able to bring about longitudinal movement towards each other of the container and the striker under conditions such as to cause the striker to perforate the container, in particular on impact on a target and given that the impact energy is intentionally limited to assure the non-lethal character of the projectile.

Striking can involve longitudinal movement of the striker relative to the transverse wall that carries it but it is preferable for the striker to be attached to that wall. Striking can then result from longitudinal crushing of the body, in which case the means for enabling or causing longitudinal movement towards each other of the container and the striker and perforation of the container by the striker include a longitudinally compressible area of the body between the container and the transverse wall in the longitudinal direction or such crushing is complemented or replaced by inertial sliding of the container inside the body towards the striker, in which case the means for enabling or causing longitudinal movement towards each other of the container and the striker and perforation of the container by the striker include mounting the container so as to slide longitudinally relative to the body, the striker and the wall being in front of the container.

The above two designs of the means for enabling or causing longitudinal movement towards each other of the container and the striker and perforation of the container by the striker can be combined and different means can be chosen, for example pyrotechnic means initiated by the impact or by firing the projectile, with a time-delay in the latter case, these examples being in no way limiting on the invention. Striking by longitudinal crushing of the body is associated with striking caused by the inertia of the body itself upon impact on a target in a particular longitudinal direction while striking by sliding of the container towards the striker is compatible with any mode of striking, in particular one relying on the inertia of the container on impact on a target in a particular longitudinal direction or on pyrotechnic or mechanical-pyrotechnic means that generally do not require an impact to supply the striking energy.

The skilled person will readily see that applications of the present invention are not limited to projectiles designed to be fired from a tube in a particular longitudinal direction and to release the pressurized fluid from the container on impact on a target in that direction and that projectiles can be made in accordance with the present invention that are designed to be projected by other means, in particular to be launched by hand in the manner of hand grenades. In such cases striking preferably relies on mounting the container to slide longitudinally relative to the body towards the striker but is advantageously achieved by means other than inertia, in particular by pyrotechnic means or mechanical-pyrotechnic means known in themselves and actuated intentionally by a user prior to launching to cause release of a gas causing the container to slide towards the striker and to be perforated by it, generally with a time-delay relative to such intentional actuation. The concepts of longitudinal and a particular longitudinal direction and derived concepts such as transverse, front and rear, nose and tail of the projectile, refer to the direction of movement of the container within the body towards the striker.

If striking relies on mounting the container to slide longitudinally relative to the body and in the case of a projectile designed to be fired from a weapon barrel the projectile in accordance with the invention advantageously includes locking means which immobilize the container relative to the body while the projectile is inside the barrel and release the container automatically so that it can slide longitudinally relative to the body when the projectile exits the barrel.

In one particularly simple but effective embodiment of such locking means the body is in the form of a wall of an elastically deformable material between the nose and the tail and has a smooth inside face to guide the container as it slides longitudinally in the body and a smooth outside face to guide the projectile as it slides longitudinally in the tube, the outside face having a localized protuberance adapted to be depressed to form a projection on the inside face when the projectile is engaged in the tube and to project from the outside face, eliminating the projection on the inside face, when the projectile has left the tube and the container has a localized transverse depression facing this protuberance when the container is juxtaposed to the striker.

The localized depression in the container can advantageously be in the form of a transverse annular groove and the protuberance on the wall of the body can then be in the form of a transverse bead joined to that wall without any discontinuity. The wall of the body of the projectile can incorporate at least one elastically flexible tongue having one end attached to the wall and offset relative to the protuberance and a free end carrying the protuberance and to which the protuberance is attached: there is preferably a plurality of tongues equi-angularly distributed around the wall of the body and the tongues are advantageously longitudinally oriented.

In all its embodiments the aforementioned protuberance not only prevents the container from sliding inside the tube, which could lead to accidental striking, but also contributes to retaining the projectile inside the tube in that it is urged elastically towards the exterior of the body and presses against the inside of the tube. In a particular instance where the protuberance is in the form of a transverse bead joined without discontinuity to the wall of the body, the protuberance further provides a seal between the projectile and the tube so that the projectile is fired by gas pressure developed inside the tube behind the projectile, for example the pressure of a gas such as compressed air introduced into the tube or the pressure of gases produced by combustion of a pyrotechnic charge.

In a manner that is widely known in the field of projectiles, when the projectile in accordance with the invention is designed to be fired from a weapon barrel in a particular longitudinal direction it advantageously has stabilizing fins attached to the tail end of the body and adapted to occupy a retracted position in which they are retained in an elastically stressed manner by the barrel when the projectile is engaged therein, their elasticity deploying them when the projectile has left the barrel.

The fins are advantageously made from an elastically deformable material and have one end attached to the body and a free end tending by virtue of its elasticity to spread transversely outwards relative to the end attached to the body, which is particularly simple, economic and reliable, and can advantageously be shaped to produce a whistling sound when the projectile is in flight which indicates firing and imminent impact.

The projectile in accordance with the invention can further include arrangements known in themselves such as a nose cone attached to its nose and made from an elastically compressible material, for example a material with a Shore A hardness in the range approximately 10 to approximately 30, preferably in the range 12 to 15, for example silicone.

BRIEF DESCRIPTION OF THE DRAWINGS

Further features and advantages of a projectile in accordance with the invention emerge from the following description given by way of non-limiting example and from the accompanying drawings that form an integral part of the description.

DETAILED DESCRIPTION OF THE INVENTION

Figure 1:
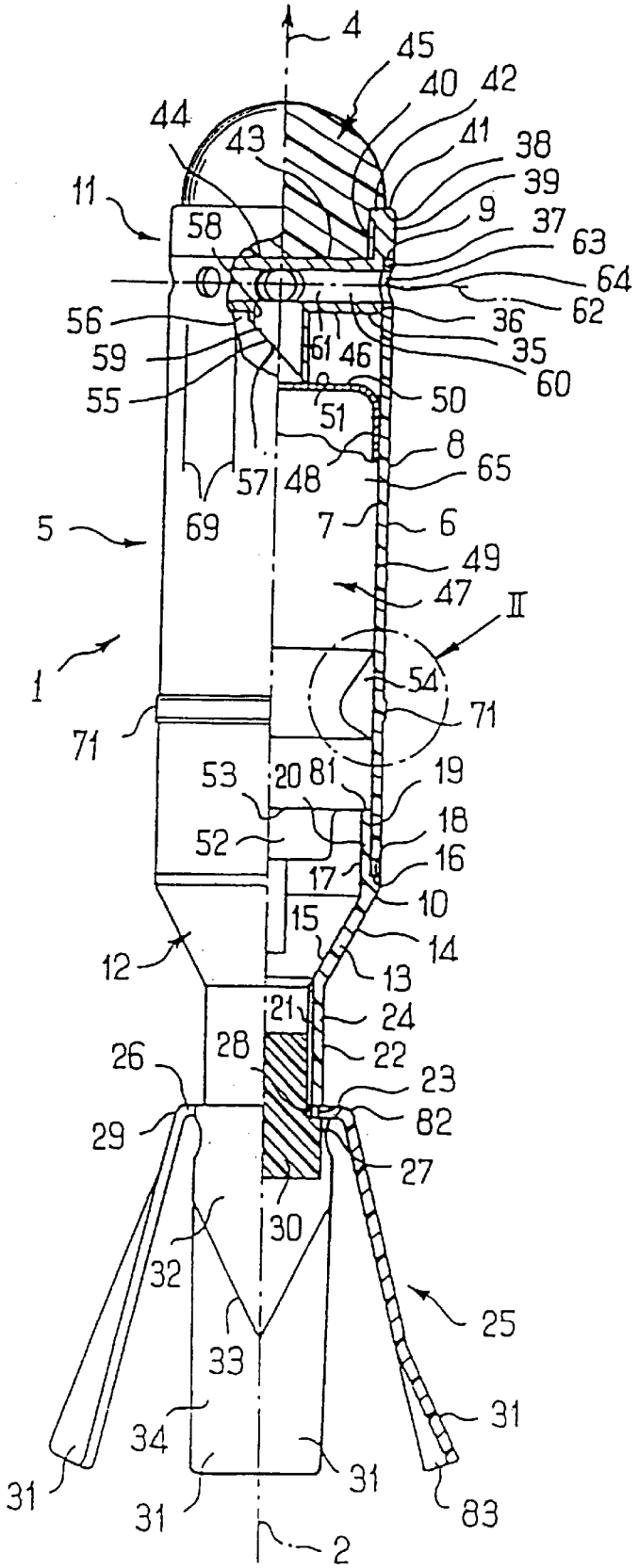
FIG. 1 shows a projectile in accordance with the invention after it has left the tube but before it has impacted on a target, half in elevation and half in section on a half-plane defined by a longitudinal axis of the projectile.

The respective embodiments of a projectile in accordance with the invention shown in FIGS. 1 through 4 and in FIGS. 5 through 8 are highly similar and their common parts are described first and are identified by the same reference numbers in all the figures. The description initially refers to all the figures.

The projectile 1 has a longitudinal axis 2 which, before the projectile is fired, lies concentric with a tube, for example a weapon barrel 3, in which it is initially inserted and from which it emerges in a predetermined longitudinal direction 4 when fired. In the present context longitudinal and transverse are relative to the axis 2, and front and rear are relative to the firing direction 4.

The projectile 1 has a body 5 defined in the example shown by:

- a longitudinal tubular wall 6 defined by circular cylindrical inside and outside faces 7 and 8 which are concentric with the axis 2 and smooth, with one exception to be described later, and by two plane circular transverse faces concentric with the axis 2, namely a front face 9 and a rear face 10, respectively connecting the faces 7 and 8 at the front and at the rear of the body 5;
- a nose 11 defining a front end of the body 5 and fixed to the wall 6, for example by nesting and gluing it in an area of its inside face 7 directly adjoining the front face 9, the nose 11 being generally circular and concentric with the axis 2 apart from exceptions described below; and
- a tail 12 defining a rear end of the body 5 and fixed to the wall 6, for example by nesting and gluing it in an area of its inside face 7 directly adjoining its rear face 10, the tail 12 having a generally circular tubular shape concentric with the axis 2.

The tubular wall 6 is made from an elastically flexible material such as a plastics material from which the tail 12 can also be made.

The tail 12 has a wall 13 delimited by circular frustoconical outside and inside faces 14 and 15 which are concentric with the axis 2 and decrease in size towards the rear. Towards the front each of the faces 14 and 15 is joined to a respective circular cylindrical face concentric with the axis 2, namely an outside face 16 having the same diameter as the outside face 8 of the wall 6 and an inside face 17 having a smaller diameter than the inside face 7 of the wall 6. Towards the front, the outside face 16 is joined to a plane circular annular shoulder 18 concentric with the axis 2, facing towards the front and abutting towards the front against the rear face 10 of the wall 6. The shoulder 18 connects the outside face 16 to another outside face 19 of the tail 12. The outside face 19 is a circular cylinder concentric with the axis 2 and substantially the same diameter as the inside face 7 of the wall 6 so as to espouse an area of the inside face 7 directly adjacent the rear face 10 of the wall 6. The inside and outside faces 17 and 19 of the tail 12 therefore define, relative to the wall 13, a tubular nesting rim 20 inside the wall 6. Towards the front inside and outside faces 17 and 19 of the rim 20 are joined by a plane circular annular shoulder 81 concentric with the axis 2 and delimiting the rim 20 towards the front. The longitudinal distance between the shoulders 18 and 81 is much less than the longitudinal dimension of the wall 6 between its front and rear faces 9 and 10.

Towards the rear, the outside and inside faces 14 and 15 of the wall 13 are joined to a respective circular cylindrical face concentric with the axis 2, namely an outside face 22 and an inside face 21 joined at the rear by a plane circular annular shoulder 23 concentric with the axis 2 and facing towards the rear, delimiting a tubular end-piece 24.

The tubular end-piece 24 is used to fix to the body 5 a tail fin assembly 25 adapted to spin the projectile 1 about the axis 2 after it is fired in order to stabilize its trajectory.

The tail fin assembly 25 is advantageously made by pressing and heat-forming a sheet of elastically flexible plastics material to define:

- a flat fixing base 26 oriented transversely to and concentric with the axis 2 and having a central longitudinal hole 27 through it delimited by a circular cylindrical inside face 28 concentric with the axis 2 and substantially the same diameter as the inside face 21 of the end-piece 24 and an outside periphery 29 in the form of a regular polygon, to be more precise one with four sides in the example shown, inscribed within a circle having a diameter less than that of the outside face 8 of the wall 6, referred to the axis 2; the central hole 27 and the inside face 21 of the end-piece 24, which are appropriately screwthreaded, receive, from the rear, a bolt coaxial 30 for clamping the base 26 flat against the shoulder 23 of the end-piece 24 in order to attach the tail fin assembly 25 to the body 5; and
- the same number of elastically flexible fins 31 as there are sides on the polygon defined by the periphery 29 of the base 26, namely four fins 31 in the example shown, each fin having a front end 82 attached to the base 26 along one side of the polygon and a free end 83 at the rear which, by virtue of the elasticity of the material from which the tail fin assembly 25 is made, tends to spread transversely outwards relative to the front end 82, in other words to a greater distance from the axis 2 than the front end, with the result that the tail fin assembly 25 has a rearwardly flared shape with a diameter greater than that of the outside face 8 of the wall 6 referred to the axis 2. However, fins 31 can be folded towards that axis to a diameter corresponding to that of the outside face 8 of the wall 6, which is the configuration of the tail fin assembly 25 when the projectile 1 is engaged in the weapon barrel 3; by virtue of their elasticity the fins 31 automatically return to the rearwardly flared position of the tail fin assembly 25 as soon as the projectile 1 has left the weapon barrel 3 when it is fired.

The fins 31 are helically shaped to spin the projectile 1 about the axis 2 during its flight between the weapon barrel 3 and its impact on the target in order to stabilize its trajectory. For example, each fin 31 has a first plane flat 32 the shape of a right-angle trapezium the side of which perpendicular to the bases coincides with a side of the periphery 29 of the base 26 to constitute the front end 82 of the fin 31 and the longer base of which extends to the free end 83 thereof, so that the first flat 32 has the oblique side of the trapezium towards the rear, defining a rectilinear fold 33 in the fin 31, and a second plane flat 34 the shape of a right-angle triangle the hypotenuse of which coincides with the fold 33, the longer side adjoining the right angle extending the shorter base of the right-angle trapezium defined by the first flat 32 at an angle to the shorter base so that the flat 34 is offset outwards relative to the flat 32 and the shorter side adjoining the right angle defining the free end 83 of the fin 31.

The choice of the material for the tail fin assembly 25 and the conformation of the fins 31 will be advantageously made, in the field on the normal aptitude of the skilled person, such that the flight of the projectile 1 is accompanied by a whistling noise.

The nose 11 includes a flat rigid transverse wall 35, for example a metal wall, delimited in the direction away from the axis 2 by an outside face 36 having a diameter substantially equal to that of the inside face 7 of the wall 6 inside which the wall 35 therefore nests with intimate mutual contact between the faces 36 and 7 in the immediate proximity of the front face 9 of the wall 6.

Towards the front, the outside face 36 is joined to a plane circular annular shoulder 37 concentric with the axis 2, the shoulder 37 facing towards the rear and bearing flat against the front face 9 of the wall 6 to limit entry of the wall 35 inside the wall 6. In the direction away from the axis 2 the shoulder 37 is itself joined to a circular cylindrical outside face 38 concentric with the axis 2 and having the same diameter as the outside face 8 of the wall 6, which the face 38 extends towards the front with no apparent discontinuity. In the direction away from the axis 2 the outside face 38 delimits a circular annular rim 39 concentric with the axis 2, in one piece with the wall 35 and projecting towards the front. In the direction towards the axis 2 the rim 39 is delimited by a circular cylindrical inside face 40 concentric with the axis 2; towards the front it is delimited by a plane circular annular face 41 concentric with the axis 2 and which is joined to the outside face 38 by a rounded edge (no reference number) and to the inside face 40 by a circular annular flange 42 concentric with the axis 2 and projecting towards it relative to the inside face 40 in an area at the front end of that face. Towards the rear the inside face 40 of the rim 39 is joined to a flat front face 43 of the wall 35 which is transverse to the axis, to be more precise in the form of a disc perpendicular to and concentric with the axis 2; the face 43 is coplanar with the shoulder 37, for example.

The face 43, the face 40 and the flange 42 therefore define immediately in front of the wall 35 a cavity 44 to receive a nose cone 45 and to immobilize it, for example by crimping it by means of the flange 42 and gluing it; the nose cone is circular, concentric with the axis 2 and designed to withstand impact with the target and to this end is made from a material having the elasticity of rubber, for example silicone having a Shore A hardness in the range 10 to 30, preferably in the range 12 to 15, although this example is in no way limiting on the invention. To this end the nose cone 45 has a hemispherical shape projecting towards the front relative to the front face 41 of the rim 39, the center of this hemisphere (no reference number) being located at the intersection of the axis 2 with a geometrical plane defined by the rim 41 and, projecting rearwardly into the cavity 44, a cylindrical tenon prestressed in compression inside the flange 42 to achieve a crimping effect and glued flat against the front face 43 of the wall 35, these examples of its fixing being in no way limiting on the invention.

Towards the rear, the wall 35 is delimited by a plane transverse face 46 parallel to the face 43 and in the shape of a circular annulus concentric with the axis 2. In the direction away from the latter axis the face 46 is joined to the face 36, the distance between the faces 43 and 46 also defining the longitudinal direction of the face 36 and consequently the depth to which the wall 35 is pressed inside the wall 6, which distance is small in comparison to the longitudinal dimension of that wall between its front and rear faces 9 and 10 so that the longitudinal distance between the face 46 of the wall 35 and the shoulder 81 of the tail 12 essentially constitutes the free longitudinal dimension of the wall 6.

A sealed container 47 of a pressurized fluid, in particular an incapacitating fluid or a marking fluid, to be dispersed by the projectile 1 after its impact on a target in the direction 4 is mounted to slide longitudinally inside the wall 6, guided by the inside face 7 thereof over this longitudinal distance.

The shape of the container 47 is such that it can co-operate either with a slide attached to the container 47 and sliding longitudinally against the inside face 7 of the wall 6, in a manner that is not shown but will be obvious to the skilled person, the inside face 7 of the wall o guiding this longitudinal relative sliding, or directly with the inside face 7 of the wall 6, as in the example shown in which the container 47 is in the form of an aerosol cartridge having a circular tubular lateral wall 48 concentric with the axis 2 and essentially delimited in the direction away from that axis by a circular cylindrical outside face 49 concentric with that axis and having a diameter substantially identical to that of the inside face 7 of the wall 6 so that sliding contact is established between the faces 49 and 7 to guide fins relative longitudinal sliding. Towards the front the wall 48 is joined to (or advantageously made in one piece with) a flat end wall 50 perpendicular to the axis 4 and delimited towards the front by a plane face 51 in the form of a disc concentric with the axis 2 and in the direction away from the axis 2 joined to the face 49 by a rounded edge. Towards the rear the wall 48 is firmly and sealingly crimped to a filler valve mechanism 52 disposed on the axis 2 and facing towards the rear, the crimping producing to the rear of the outside face 49 a plane circular annular shoulder 53 concentric with the axis 2 and facing towards the rear. Nearer this shoulder 53 than the front face 51 the wall 48 is locally deformed towards the axis 2 so as to form inside the container 47 a rib limiting penetration of the valve mechanism 52, which will be familiar to the skilled person, and this deformation creates in the outside face 49 of the wall 48 a depression in the form of a circular annular groove 54 concentric with the axis 2 and nearer the shoulder 53 than the front face 51.

Figure 2:
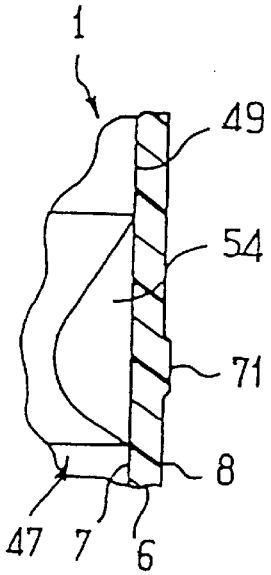
FIG. 2 shows the detail II from FIG. 1 to a larger scale.

The longitudinal distance between the shoulder 53 and the front face 51 is less than the longitudinal distance between the shoulder 81 and the rear face 46 of the wall 35, with the result that the container 47 can occupy the position shown in FIGS. 1 and 2 inside the body 5 and the projectile 1 in which the shoulder 53 bears rearwardly on the shoulder 81 of the tail 12, the valve mechanism 52 being freely received in a coaxial arrangement inside the tail, and in which its front face 51 is spaced longitudinally from the rear face 46 of the wall 35, which corresponds to the position that the container 47 occupies inside the body 5 of the projectile 1 before it is fired and in flight after it is fired and until impact occurs.

For such impact to perforate the end wall 50 of the container 47, i.e. to release the fluid that it contains, the rear face 46 of the wall 35 has a striker 55 on its rear face 46 in the form of a hollow longitudinal needle projecting towards the rear along the axis 2, the needle being beveled towards the rear and having a longitudinal dimension parallel to the face 46 substantially equal to the difference between the longitudinal distance between the shoulder 81 and the face 46 and the distance between the shoulder 53 and the face 51; as a result, in the position shown in FIGS. 1 and 2, i.e. in the position prior to impact, the striker 35 is brought into contact with the front face 51 of the container 47 with its shoulder 53 resting on the shoulder 81 of the tail 12, as yet without any force.

The striker 55 is advantageously made in one piece with the wall 35 and is delimited in the direction away from the axis 2 by a circular cylindrical outside face 56 concentric with that axis and having a diameter significantly less than that of the inside face 7 of the wall 6. The outside face 56 is joined towards the front to the rear face 46 of the wall 35 and towards the rear to a plane annular face 57 which is inclined to the axis 2, for example at 45°, and faces downwards, which defines for the striker 55 a beveled free rear end and connects the outside face 56 to a circular cylindrical inside face 58 concentric with the axis 2 and delimiting inside the striker 55 a longitudinal passage 59 open towards the rear inside the beveled face 57 and extending towards the front as far as the inside of the wall 35, where it is closed at the front. However, inside the wall 35 the passage 59 discharges into a plurality of passages 60, of which there are eight in the example shown, and which radiate from it, radially relative to the axis 2, as far as the outside face 36 of the wall 35 onto which they open. Each passage 60 is defined by a circular cylindrical inside face 61 concentric with a respective axis 62 perpendicular to the axis 2, for example, the various axes 62 being equi-angularly distributed around that axis and the respective diameters of the inside faces 61 being equal to each other but less than the diameter of the inside face 58 of the striker 55. The wall 6 has a hole 63 through it facing and coaxial with each of the passages 60 and delimited by a circular cylindrical inside face 64 concentric with the respective axis 62 and having a diameter identical to that of the inside face 61 of a passage 60 so that the passage 59, the passages 60 and the holes 63 establish communication between the outside of the body 5 and a sealed cavity 65 defined by the walls 6 and 35 and the tail 12 and in which the container 47 is housed. Naturally other arrangements of the passages 60 in the wall 35 and other numbers of passages can be chosen without departing from the scope of the invention.

Figure 4:
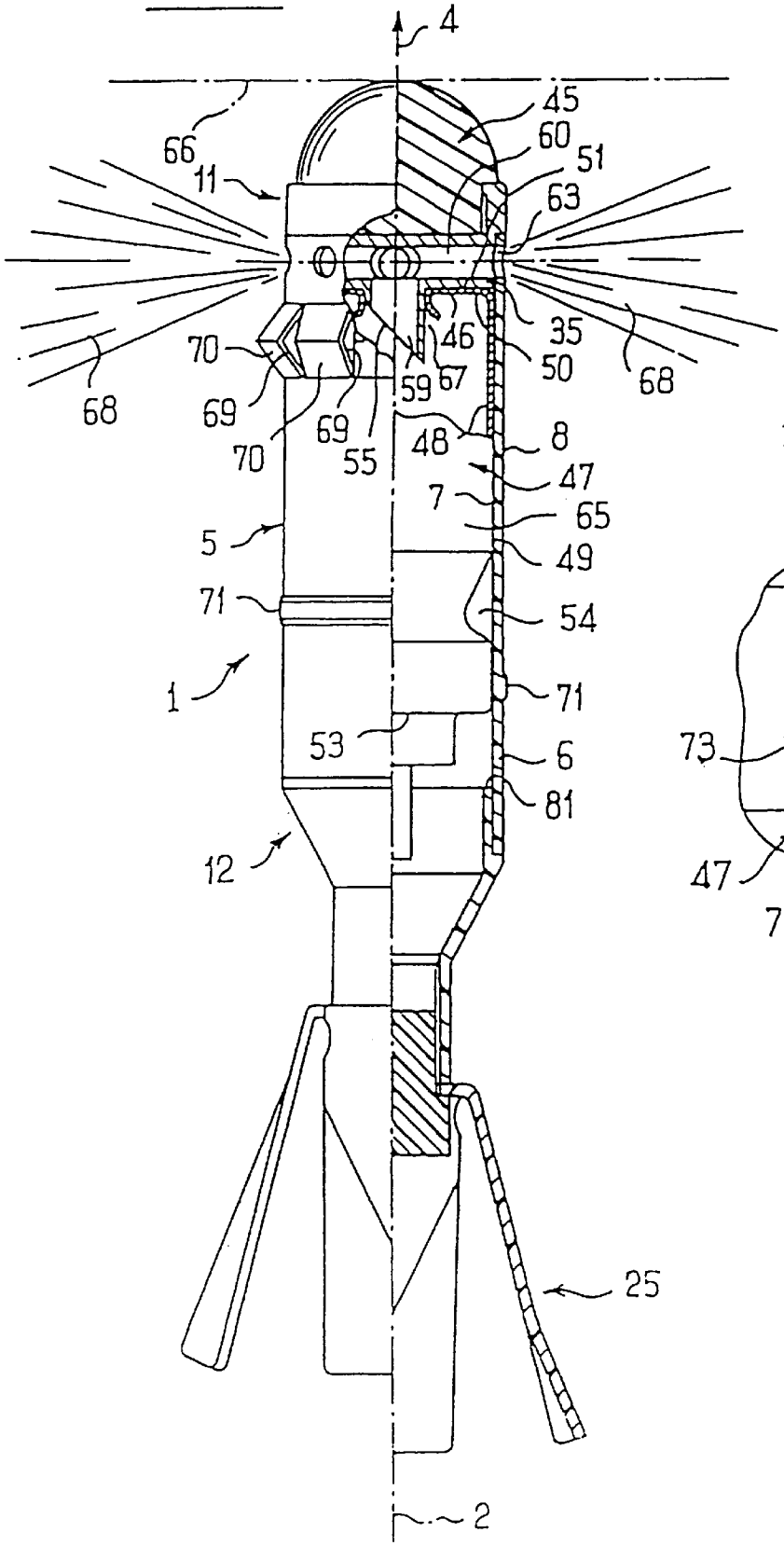
FIG. 4 is a view similar to that of FIG. 1 showing the projectile after impact on its target, two different behaviors of the projectile on impact being shown in respective halves of this figure.

Accordingly, when the projectile 1 impacts on its target 66 in the direction 4 after leaving a weapon barrel, as shown in FIG. 4, because of its inertia the container 47 tends to continue to move forwards inside the wall 6, which is immobilized in this direction by the target 66, and bears with a high force towards the front on the striker 55 which perforates the end wall 50. This frees the container 47 to slide towards the front relative to the wall 6 with the result that the container 47 moves forwards in the body 1 until the face 51 of its end wall 50 is pressed flat against the rear face 46 of the wall 35, as shown in FIG. 4. The pressurized fluid 68 initially enclosed in the container 57 escapes from it through the perforation 67 produced in this way in the end wall 50, flowing towards the front through the longitudinal passage 59 in the striker 55 and then in the centrifugal direction relative to the axis 2 through each of the passages 60 and the holes 63 until it escapes transversely from the body 5 of the projectile 1 to spread over the target 66.

This process, relying exclusively on sliding of the container 47 towards the front inside the body 5, is shown in the right-hand half of FIG. 4.

The left-hand half of the figure shows a different embodiment of the projectile in which the above effect is complemented or replaced by longitudinal crushing of the wall 6 on impact.

Longitudinal compression of the wall 6 can be encouraged at least in an area longitudinally between the container 47 and the transverse wall 35, for example as shown in the left-hand half of FIG. 1, by making longitudinal cuts 69 part-way through the outside face 8 of the wall 6 and localized immediately to the rear of the rear face 46 of the wall 35, the cuts having a longitudinal dimension preferably corresponding to approximately twice the longitudinal distance between the front face 51 of the container 47 and the rear face 46 of the wall 35 when, as shown in the right-hand half of FIG. 1, the front face 51 bears towards the front against the striker 55 with no force and without causing perforation. On impact, and as shown in the left-hand half of FIG. 4, the cuts 69 open and allow the formation in the wall 6 of folds 70 on the outside face 8 of the wall 6 projecting away from the axis 2. This is accompanied by apparent shortening of the wall 6 between the shoulder 81 and rear face 46 of the wall 35, forcing the end wall 50 of the container 47 against the striker 55, which perforates it. The formation of the outward folds 70 prevents the presence of the container 47 inside the wall 6 impeding the apparent shortening of the wall 6 and impeding longitudinal sliding of the container 47 inside the wall 6 when the effects of apparent shortening of that wall and of sliding of the container 47 towards the front inside it combine to cause the striker 55 to perforate the end wall 50. In all cases the arrangement of the passage 59 through the striker 55, of the passages 60 inside the wall 35 and of the holes 63 facing the passages 60 prevents any impediment to the exit of the fluid initially contained in the container 47.

Because of the high ductility generally evidenced by the materials, such as aluminum or aluminum-based alloys, from which the walls of the aerosol cartridges preferably used for the container 47 are made, imperfect tearing of the end wall 50 of the container 47 around the perforation 67 can occur, in the sense that the tearing produces in the end wall 50 a tongue that remains attached to the rest of the end wall and is pressed against the annular face 57 on which the passage 59 discharges longitudinally towards the rear, which blocks the passage 59 and consequently prevents the fluid reaching the passages 60 and the holes 63.

Figure 8:
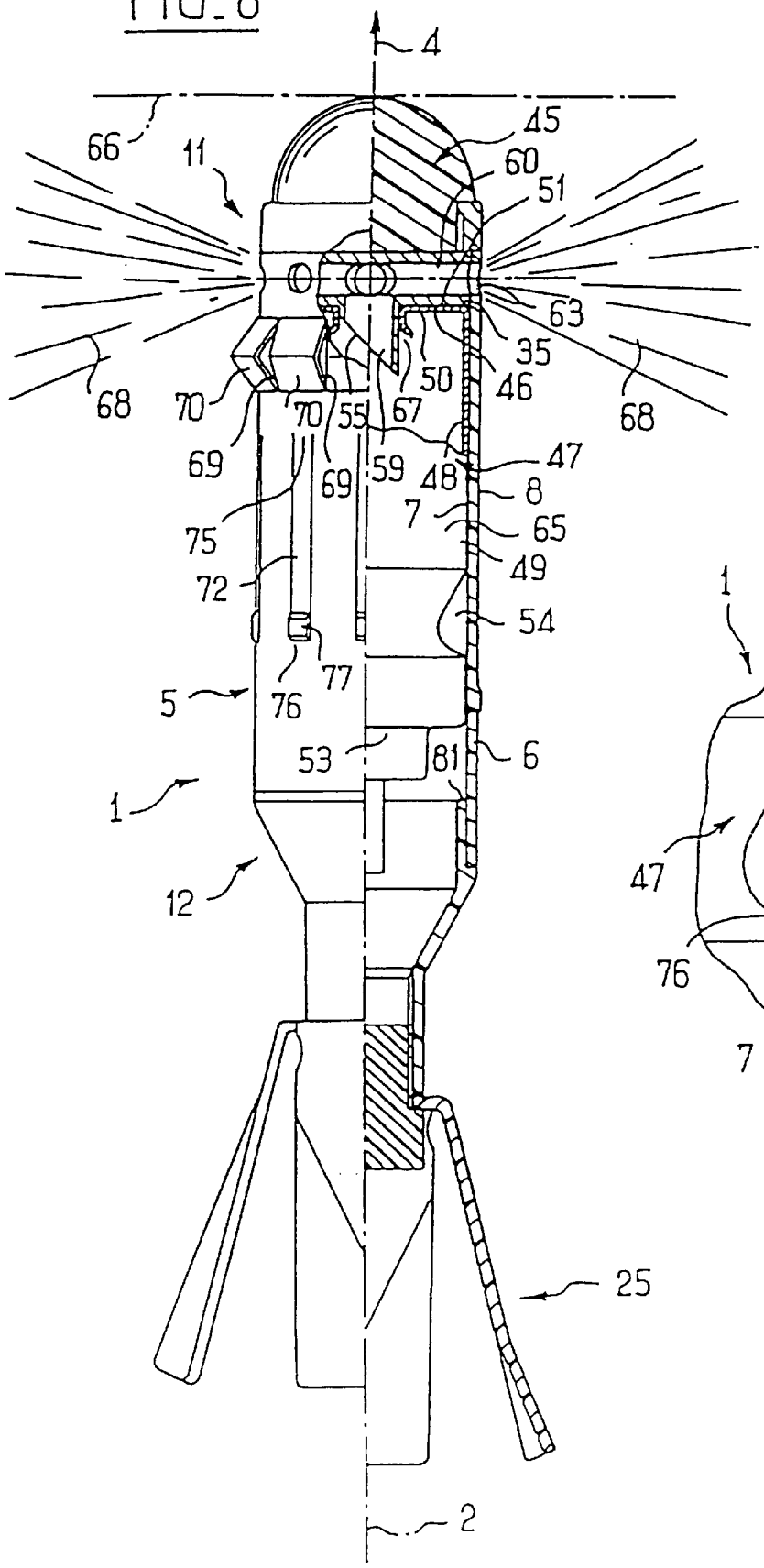
Figure 9:
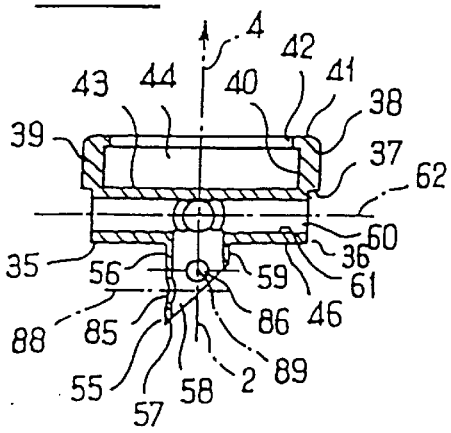
FIGS. 9 and 10 are sectional views analogous to those of FIGS. 1, 4, 5 and 8 of two preferred embodiments of a component combining the striker and the transverse wall carrying it.
Figure 11:
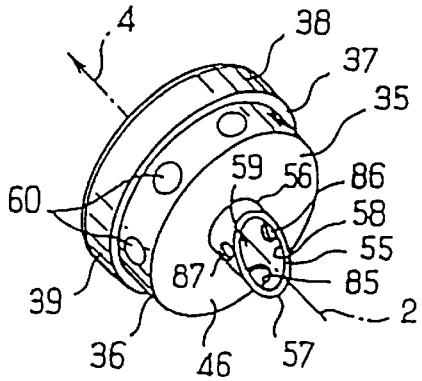
FIGS. 11 and 12 are perspective view of these two preferred embodiments.
Figure 10:
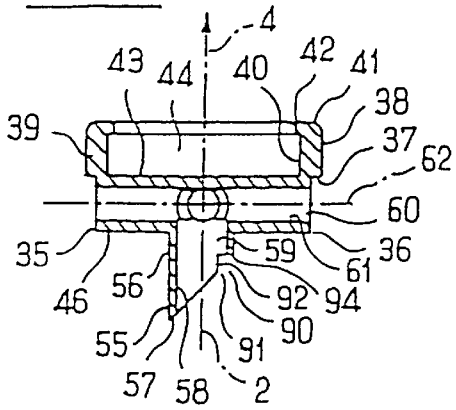
Figure 12:
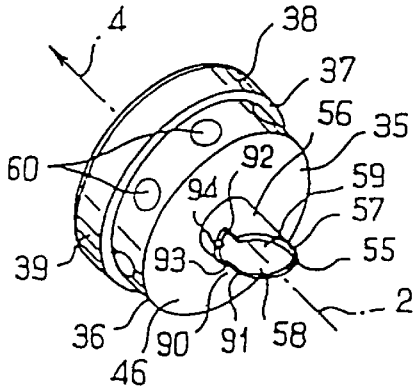
Figure 13:
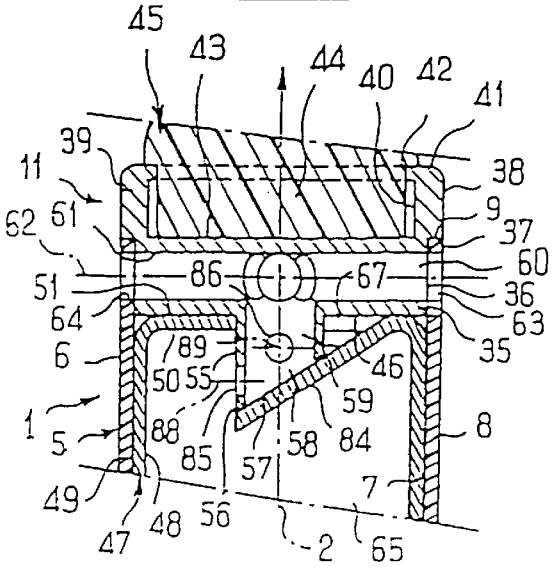
FIGS. 13 and 14 are views corresponding to those of FIGS. 4 and 8 but localized to the striker and the transverse wall carrying it and showing the co-operation of the container with the aforementioned two preferred embodiments after it is perforated following impact of the projectile on its target.
Figure 14:
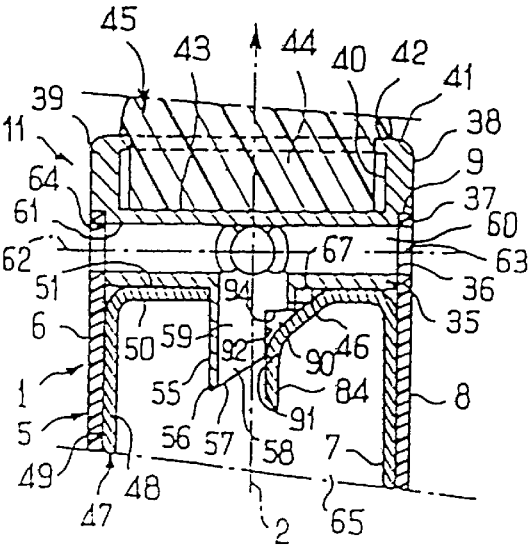

This risk can be overcome or eliminated by shaping the striker 55 differently, for example as in a variant shown in FIGS. 9, 11, 13 or a variant shown in FIGS. 10, 12, 14, it being understood that the other components of the projectile can be the same as in either of the embodiments described above. FIGS. 9 through 14 therefore show, identified by the same reference numbers as used in FIGS. 1 through 8, various components identical to components described with reference to those figures with the exception of localized differences that will now be described.

Referring at first to FIGS. 9, 11, 13 there is shown a variant of the striker 55 that differs from the embodiment thereof previously described only in that it has at least one transverse orifice through it, extending between its inside and outside faces 58 and 56 and therefore opening into the passage 59 and into the body 5 to the rear of the wall 35, to be more precise at a longitudinal distance from the rear face 46 of that wall at least equal to and preferably greater than the thickness of the end wall 50.

In the non-limiting example shown there are three such orifices 85, 86, 87 each of which is oriented along a respective axis perpendicular to the axis 2 and has a circular cylindrical periphery concentric with the respective axis and a diameter that is as large as possible within limits compatible with the mechanical strength of the striker 55 so as to offer to the fluid a cumulative flow cross-section that is as close as possible to that of the passage 59.

To be more precise, in the example shown in FIGS. 9 and 13 in which the annular face 57 is oriented perpendicularly to the section plane, the orifice 85 is on an axis 88 in that plane and intersects the axis 2 perpendicularly where that axis intersects the geometrical plane (no reference number) of the face 57; the orifices 86 and 87 have a common axis 89 perpendicular to the plane of FIGS. 9 and 13 and intersecting the axis 2 perpendicularly between the intersection of the axis 88 with the axis 2 and the rear face 46 of the wall 35; they have the same diameter, which is less than that of the orifice.

Accordingly, even if striking the end wall 50 upon impact of the projectile 1 on its target produces a tongue 84 from the end wall 50 that is pressed against the face 57 and therefore blocks the passage 59 towards the rear, as shown in FIG. 13, the latter communicates with the interior of the container 47 via the orifices 85, 86, 87 which are to the rear of the end wall 50 and so enable the fluid in the container 47 to escape from it and exit the projectile 1 via the passage 50, the passages 60 and the holes 63.

Naturally, the scope of the invention would not be exceeded by choosing other arrangements to preserve communication between the inside of the container 47 after it is perforated and the passage 59, even if a tongue 84 formed from the material of the end wall 50 should block it towards the rear.

Nor would the scope of the present invention be exceeded by conforming the striker 55 to prevent the formation of any such tongue 84 or at least blocking of the passage 59 thereby, and a variant of the striker 55 with this aim in view will now be described with reference to FIGS. 10, 12, 14. The skilled person will readily realize that, although this variant is described independently of that shown in FIGS. 9, 11, 13, the two variants could easily be combined.

In the variant shown in FIGS. 10, 12, 14 the striker 55 differs from that described with reference to FIGS. 1 through 8 only in that its free end at the rear is hollowed out by a step 90 offset towards the front relative to its annular face 57 in the area thereof nearest the wall 35 and opens longitudinally towards the rear in this area and transversely onto the inside and outside faces 58 and 56.

To be more precise, in the example shown the annular face 57 has a localized interruption 91 in its area nearest the wall 35, symmetrical about a plane perpendicular to the annular face 57 and including the axis 2, namely the plane of FIG. 11, and the step 90 is delimited by two plane longitudinal faces 92, 93 symmetrical to each other about that plane and joined towards the rear to the annular face 57 on respective opposite sides of the interruption 91 therein and by a plane transverse face 94 facing towards the rear and connecting the two longitudinal faces 92, 93 together in front of the annular face 57. However, the transverse face 94 is preferably at a longitudinal distance to the rear of the face 46 of the partition 35 greater than the thickness of the end wall 50 of the container 47.

The two longitudinal faces 92, 93 are in a common plane (no reference number) parallel to the axis 2 and perpendicular to the plane of FIG. 11, for example. As shown here, the plane of the faces 92, 93 is preferably on the same side of the axis 2 as the area of the annular face 57 nearest the wall 35 so that the interruption 91 in the annular face 57, and with it the step 90, extends over less than half the periphery of the annular face 57, for example over 120° referred to the axis 2, this value being given purely by way of non-limiting example.

The skilled person will readily understand that other shapes can be adopted for the step 90 without departing from the scope of the invention.

When, as the projectile impacts on its target, the end wall 50 of the container 47 moves forwards, towards the wall 35, it comes into contact with the striker 55 first by means of the area of the beveled face 57 at the greatest distance from the wall 35, what perforates it and can lead to the progressive formation of a tongue 84 as the end wall 50 comes into contact with areas of the face 57 progressively closer to the wall 35; the tongue 84 tends to remain pressed against the face 57 in an oblique orientation relative to the axis 2. When the end wall 50 reaches the interruption 91 in the face 57 it crosses the step 90, the longitudinal faces 92, 93 and then the transverse face 94 of which straighten the tongue 84, in such away as to tend to orient it parallel to the axis 2 before the end wall 50 abuts towards the front against the face 46 of the wall 35, as shown in FIG. 14; when the container 47 stops against the face 46 of the wall 35 any tongue 84 that may have been formed from its end wall 50 is therefore oriented so that there is no risk of it blocking the mouth of the passage 59 of the striker 55 on the annular face 57, i.e. it cannot in any way impede exit of the fluid initially contained in the container 47 via the passage 59, the passages 60 and the holes 63.

Figure 5:
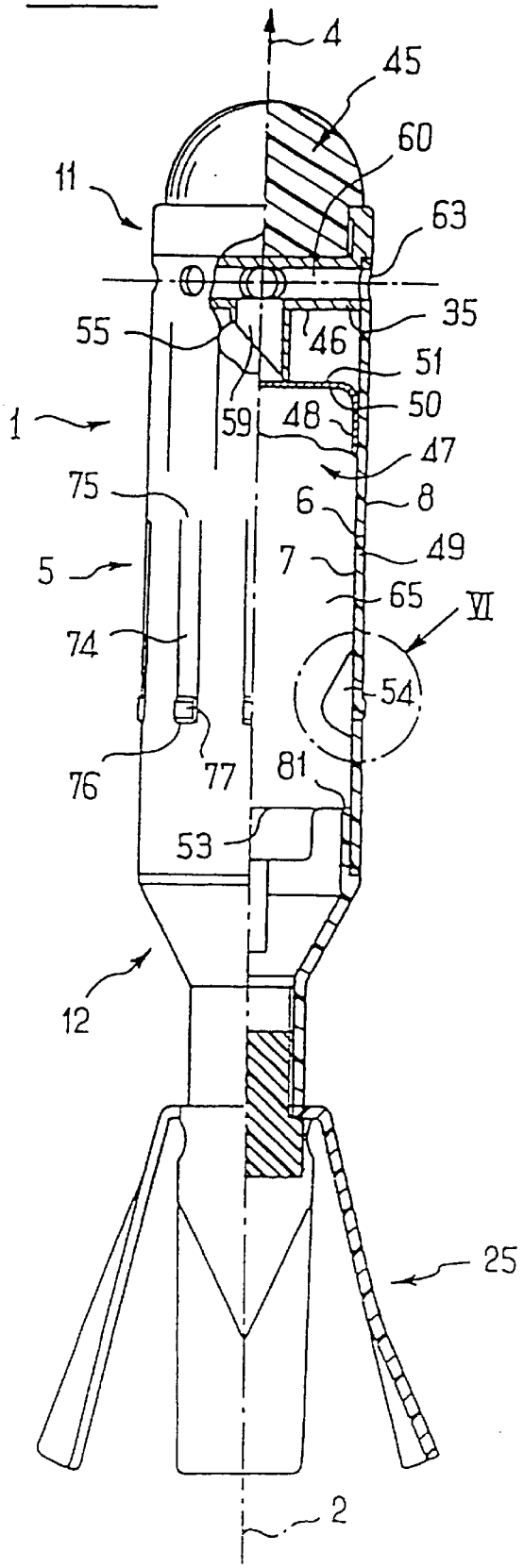
FIGS. 5 through 8 are views respectively corresponding to those of FIGS. 1 through 4 and show a different embodiment of the projectile, FIG. 6 showing a detail VI from FIG. 5.
Figure 6:
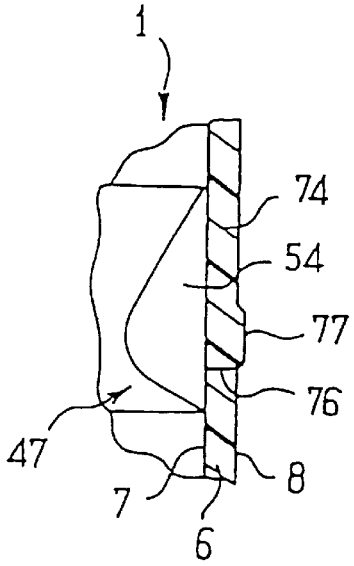
Figure 7:
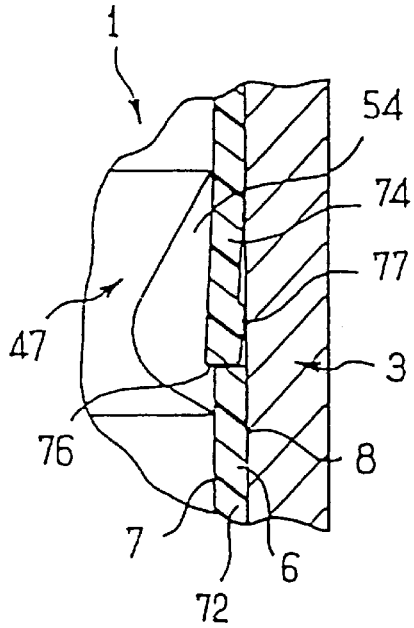

To prevent accidental perforation of the container before impact on a target 66, and in particular during storage of the projectile, during loading of the weapon (not shown) and when the weapon is being handled, locking means are preferably provided to immobilize the container 47 relative to the body 5 while the projectile 1 is inside the weapon barrel 3 and to release the container 47 automatically so that it can slide longitudinally relative to the body 3 when the projectile 1 leaves the weapon barrel 3. FIGS. 1 through 4 show a first embodiment of the locking means and FIGS. 5 through 7 show a second embodiment and it is to be understood that these embodiments are also compatible with the variants of the striker shown in FIGS. 8 through 14.

Refer firstly to FIGS. 1 through 4, which show the locking means in the form of a circular annular transverse bead 71 concentric with the axis 2, projecting on the outside face 8 of the wall 6 of the body 5 in an area transversely facing the groove 54 and forming a depression in the outside face 49 of the wall 48 of the container 47 when the shoulder 53 bears towards the rear on the shoulder 81 of the tail 12 of the body 5.

Figure 3:
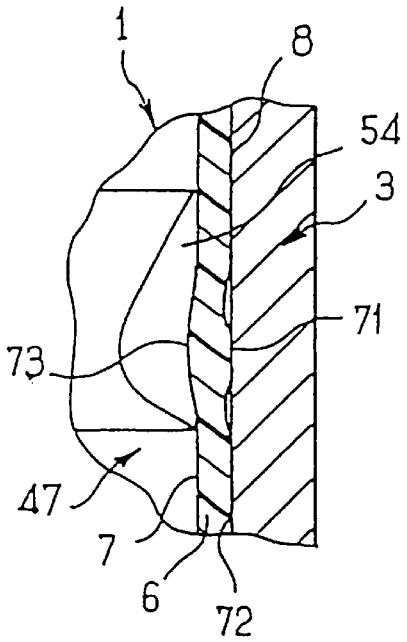
FIG. 3 shows the same detail when the projectile is still inside the tube.

The bead 71 is continuous, joined with no discontinuity to the wall 6 and advantageously made in one piece with that wall. When, as shown in FIG. 3, the projectile 1 is inserted into the weapon barrel 3, which has a circular cylindrical inside face 72 concentric with an axis coincident with the axis 2 and a diameter substantially identical to that of the outside face of the wall 6 in order to co-operate with the outside face 8 to guide the body 5 as it slides longitudinally in the weapon barrel 3 when fired, the bead 71 bears on the inside face 72 which compresses it towards the axis 2 which causes at least partly elastic deformation, and where necessary slightly plastic deformation, of the wall 6 in the direction towards the axis 2. This forms on the inside face 7 of the wall 6 a circular annular bead 73 concentric with the axis 2 and projecting towards that axis relative to the inside face 7 of the wall 6, i.e. entering the groove 54 to immobilize the container 57 relative to the wall 6 in the position with the shoulder 53 bearing on the shoulder 21.

The bead 71, which is stressed against the inside face 72 of the weapon barrel 3 because of the elasticity of the material of which the wall 6 is made, retains the projectile 1 because of friction between the inside face 72, on the one hand, and a seal between the projectile 1 and the face 72, on the other hand, in a manner that is particularly advantageous when, as is frequently the case, the projectile 1 is fired by accumulating pressurized gas between it and a bolt (not shown) closing the rear end of the barrel 3, whether by introducing a pressurized gas or by generating a pressurized gas, for example by combustion of a suitable pyrotechnic substance.

When the projectile has left the weapon barrel 3, as shown in FIGS. 1, 2, 4, the elasticity of the wall 6 causes the bead 71, which has been relieved of the pressure previously applied to it by the inside face 72, to return to its original configuration, i.e. projecting on the outside face 8 of the wall 6, which eliminates the bead 73 projecting on its inside face 7 and allows the container 47 to slide forwards inside the wall 6.

Referring now to FIGS. 5 through 8, the bead 71 is dispensed with but appropriate cuts form elastically flexible tongues 74 in the wall 6. There are eight such tongues, for example, oriented longitudinally and equip-angularly distributed around the axis 2, although other arrangements and other numbers of tongues can be chosen without departing from the scope of the invention.

Each tongue 74, which is therefore in one piece with the wall 6, has one end 75, here the front end, attached to the remainder of the wall 6 and a free end 76, here the rear end, carrying and having fastened to it, for example in one piece with it, a protuberance 77 projecting away from the axis 2 on the outside face 8 of the wall 6 when, as shown in FIGS. 5, 6, 8, the projectile 1 has left the weapon barrel 3. Because of its elasticity the tongue 74 tends to retain a shape in which the corresponding part of the inside and outside faces 7 and 8 remains on the same respective geometrical cylinder as the remainder of the peripheral wall respectively inside or outside the wall 6.

On the other hand, when the projectile 1 is inside the weapon barrel 3, as shown in FIG. 7, the inside face 72 of the barrel bearing on the respective protuberance 77 eliminates the projection that the latter constitutes relative to the outside face 8 of the wall 6, i.e. it causes each tongue 74 to flex towards the axis 2 at the position of the protuberance 77, with the result that the free end 76 of each tongue 74 forms a projection towards the axis 2 on the inside face 7 of the wall 6. Because the protuberances 77 have exactly the same location as the bead 71, i.e. they coincide with the groove 54 in the wall 48 of the container 47 bearing through a shoulder 53 on the shoulder 81 of the tail 12 of the body 5 of the projectile 1, the free ends 76 of the tongues 74 enter the groove 54 and constitute an abutment opposing movement of the container 47 towards the front inside the body 5.

When the projectile 1 has left the weapon barrel 3 the force applied to its face 72 by the protuberances 77 is removed and the elasticity of the tongues 74 returns them to a position in which each protuberance 77 projects on the outside face 8. The free ends 76 of the tongues 74 are therefore retracted away from the axis 2 relative to the inside face 7 of the wall 6, freeing the container 47 to slide towards the front inside the body 5.

Assuming that, instead of sliding directly inside the body 5, the container 47 is mounted in a slide adapted to slide inside the body 5, the bead 71 or the tongues 74 could co-operate in exactly the same way as described with reference to the groove 54 with a similar groove in the slide. A solution of the above kind is not shown but how to put it into effect will be evident to the skilled person.

Naturally, other modes of locking the container 47 or the slide carrying it inside the body 5 can be chosen without departing from the scope of the invention, in particular if the movement of the container 47 leading to its end wall 50 being perforated by the striker 55 is brought about not by inertial displacement of the container 47 or by apparent shortening of the wall 6, as shown, but by other means such as pyrotechnic means with a time-fuse initiated when the projectile is fired. In this case, for example, the container 47 could be retained temporarily against sliding inside the body 5 by shear pins that break when the gas pressure generated by the aforementioned pyrotechnic means exceeds a predetermined threshold or when the combination of this effect and an inertia of the container 47 on impact exceeds the predetermined threshold at which the pins shear. How to construct this variant of the projectile 1, and likewise of the other variants, will be evident to the skilled person and is within the scope of the invention.

Likewise, although applications of the invention to a projectile 1 adapted to be fired in a given longitudinal direction 4 from a weapon barrel 3 and to release the pressurized fluid 68 from the container 47 on impact on a target 66 in this direction have been described with reference to figs. 1 through 14, it will be obvious to the skilled person how to adapt these to the case of a projectile 1 adapted to be projected by some other means, in particular launched by hand, and/or how to release the pressurized fluid from the container in a manner other than in response to impact on a target in the particular longitudinal direction, in particular by striking of the container 47 as a consequence of its longitudinal sliding inside the body 5 of the projectile 1 towards the striker 55 and towards the transverse partition 35 carrying it by action of pyrotechnic or mechanical-pyrotechnic means known in themselves, in particular intentionally operated by a user prior to launching the projectile 1.

What is claimed is:

1. A non-lethal projectile for projecting from a tube in a given longitudinal direction, and to disperse a pressurized fluid in a controlled manner by impact on a target in said direction, said non-lethal projectile comprising:

a longitudinal body having a nose at the front and a tail at the rear, a container for the pressurized fluid disposed in said body between said nose and said tail, a longitudinal striker for perforating said container juxtaposed longitudinally thereto and carried by a transverse wall attached to the body, means for enabling longitudinal movement towards each other of the container and the striker and controlled perforation of the container by the striker, by impact on the target in said direction, means for dispersing the fluid to enable the fluid to exit the body in a transversely-distributed manner on perforation of the container by the striker, wherein the means for dispersing the fluid include a blind longitudinal passage through the striker open at the end towards the container and closed inside said wall, and a plurality of transverse passages in said wall radiating from said blind longitudinal passage and opening to the exterior of the body through holes in said body.

2. A projectile according to claim 1, wherein the striker has longitudinally opposite said wall a free end in the form of a bevel onto which said blind passage opens longitudinally.

3. A projectile according to claim 1, wherein the striker has longitudinally opposite said wall a free end that includes a step set back longitudinally towards said wall and onto which said blind passage opens longitudinally.

4. A projectile according to claim 1, wherein the striker has longitudinally opposite said wall a free end in the form of a bevel onto which said blind passage opens longitudinally, said free end includes a step set back longitudinally towards said wall and onto which said blind passage opens longitudinally, the step is formed in the area of the bevel closest to said wall in the longitudinal direction.

5. A projectile according to claim 4, wherein the step extends over at least half the periphery of the bevel.

6. A projectile according to claim 1, wherein the striker has, longitudinally on the same side of said wall as the container, at least one transverse orifice that opens into said blind longitudinal passage.

7. A projectile according to claim 1, wherein the striker is attached to said transverse wall and the means for enabling longitudinal movement of the container and the striker towards each other and perforation of the container by the striker include a longitudinally compressible area of the body longitudinally between the container and said transverse wall.

8. A projectile according to claim 1, wherein the striker is attached to said transverse wall and the means for enabling longitudinal movement of the container and the striker towards each other and perforation of the container by the striker include mounting the container to slide longitudinally relative to the body, the striker and said wall being disposed in front of the container.

9. A projectile according to claim 8, further comprising locking means for immobilizing the container relative to the body when the projectile is inside the tube and to release the container automatically to slide longitudinally relative to the body when the projectile exits the tube.

10. A projectile according to claim 9, wherein the body is in the form of an elastically deformable material wall between the nose and the tail and has a smooth inside face for guiding the container when it slides longitudinally in the body and a smooth outside face for guiding the projectile when it slides longitudinally in the tube, in that said outside face has a localized protuberance to be depressed and form a projection on said inside face when the projectile is engaged in the tube and to project on the outside face and eliminate the projection on the inside face when the projectile has left the tube, and in that the container has a localized depression in it transversely facing said protuberance when the container is juxtaposed to the striker.

11. A projectile according to claim 10, wherein said localized depression is in the form of a transverse annular groove.

12. A projectile according to claim 11, wherein the protuberance is in the form of a transverse bead connected without discontinuity to the wall of the body.

13. A projectile according to claim 10, wherein said wall includes at least one elastically flexible tongue having one end attached to the wall and offset relative to said protuberance and a free end carrying said protuberance which is attached to it.

14. A projectile according to claim 8, wherein said means for enabling longitudinal movement towards each other of the container and the striker and perforation of the container by the striker are controlled by inertia.

15. A projectile according to claim 1, further comprising stabilizing fins attached to the tail of the body and to occupy a retracted position in which they are retained and elastically stressed by the tube when the projectile is engaged therein and to be deployed by virtue of their elasticity when the projectile has left the tube.

16. A projectile according to claim 15, wherein the fins are made from an elastically deformable material and have one end attached to the body and a free end tending by virtue of its elasticity to spread transversely outwards relative to the end attached to the body.

17. A projectile according to claim 15, wherein the fins are shaped to cause a whistling sound when the projectile is in flight.

18. A non-lethal projectile comprising:

a body having a nose at the front and a tail at the rear;

a container to contain a pressurized fluid, said container disposed in said body between said nose and said tail;

a striker to perforate said container, wherein said striker is enabled to automatically strike the container upon impact of said body with a target to cause perforation of the container; and a fluid passage arrangement to enable the fluid from said container to exit the body in a transversely-distributed manner upon perforation of the container by the striker, wherein said fluid passage arrangement includes a blind passage through the striker open at the end towards the container and closed at the other end, and a plurality of transverse passages extending from said blind passage to the exterior of the body.

* * * * *